US010580557B2

(12) United States Patent
Chaizy

(10) Patent No.: US 10,580,557 B2
(45) Date of Patent: Mar. 3, 2020

(54) MAGNETIC FIXINGS AND CONNECTORS

(71) Applicant: INELXIA LIMITED, Oxfordshire (GB)

(72) Inventor: Patrick Andre Chaizy, Oxfordshire (GB)

(73) Assignee: INELXIA LIMITED, Oxfordshire (GB)

( * ) Notice: Subject to any disclaimer, the term of this patent is extended or adjusted under 35 U.S.C. 154(b) by 0 days.

(21) Appl. No.: 15/627,718

(22) Filed: Jun. 20, 2017

(65) Prior Publication Data

US 2017/0301446 A1 Oct. 19, 2017

Related U.S. Application Data

(63) Continuation-in-part of application No. 14/867,700, filed on Sep. 28, 2015, now Pat. No. 9,715,960, which (Continued)

(30) Foreign Application Priority Data

May 26, 2011 (GB) ..... 1108886.1
Dec. 11, 2011 (GB) ..... 1121222.2
Jan. 30, 2012 (GB) ..... 1201493.2

(51) Int. Cl.
*H01F 7/20* (2006.01)
*H01F 7/02* (2006.01)
*H01F 7/04* (2006.01)

(52) U.S. Cl.
CPC ..... *H01F 7/0252* (2013.01); *H01F 7/0242* (2013.01); *H01F 7/0257* (2013.01); *H01F 7/0263* (2013.01); *H01F 7/04* (2013.01)

(58) Field of Classification Search
CPC . A45C 13/1069; A45C 13/1084; A41F 1/002; H01F 7/002; H01F 24/303; A44B 17/00
(Continued)

(56) References Cited

U.S. PATENT DOCUMENTS 3,177,546 A * 4/1965 Bey ..... A44B 15/002 24/303
4,231,137 A * 11/1980 Fujimoto ..... A44C 5/2071 24/303

(Continued)

FOREIGN PATENT DOCUMENTS

WO 02/41788 A1 5/2002

OTHER PUBLICATIONS

International Search Report, dated Nov. 19, 2012, and Written Opinion, issued in International Application No. PCT/EP2012/059870.

(Continued)

*Primary Examiner* — Shawki S Ismail
*Assistant Examiner* — Lisa N Homza
(74) *Attorney, Agent, or Firm* — Saul Ewing Arnstein & Lehr LLP

(57) ABSTRACT

A mechanism for fixing together first and second parts and comprising first and second guides provided respectively in or attached to the first and second parts. The mechanism further comprises first and second magnetic components coupled respectively to the first and second guides such that the first magnetic component is rotatable with the first guide and the first part, and the second magnetic component cannot rotate relative to the second guide, the magnetic components being moveable axially and rotationally with respect to each other and having magnetic poles oriented such that rotation of said first magnetic component causes relative axial movement of the magnetic components between a locking position in which one of the magnetic components straddles the two guides and an unlocking position in which it does not straddle the two guides.

10 Claims, 14 Drawing Sheets

Related U.S. Application Data is a continuation of application No. 14/119,946, filed as application No. PCT/EP2012/059870 on May 25, 2012, now abandoned.

(58) Field of Classification Search
USPC ..... 335/285
See application file for complete search history.

(56) References Cited

U.S. PATENT DOCUMENTS

| | | | | | |
|---|---|---|---|---|---|
| 5,008,984 | A * | 4/1991 | Levy | A44C 5/2042 | 24/303 |
| 5,092,019 | A * | 3/1992 | Levy | A44C 5/208 | 24/303 |
| 5,317,789 | A * | 6/1994 | Levy | A44C 5/2042 | 24/303 |
| 5,367,891 | A * | 11/1994 | Furuyama | A44C 5/2057 | 24/303 |
| 6,292,985 | B1 * | 9/2001 | Grunberger | A44B 11/2592 | 24/303 |
| 6,505,385 | B2 * | 1/2003 | Grunberger | A44B 11/2592 | 24/303 |
| 6,591,462 | B2 * | 7/2003 | Fuhrman | A44C 5/2076 | 24/303 |
| 6,981,391 | B2 * | 1/2006 | Suzuki | A44C 5/2076 | 24/303 |
| 8,752,252 | B2 * | 6/2014 | Ninomiya | H01F 7/0263 | 24/303 |
| 8,760,250 | B2 * | 6/2014 | Fullerton | G01D 18/00 | 310/156.32 |
| 2009/0043324 | A1 | 2/2009 | Paschal | | |
| 2009/0273422 | A1 | 11/2009 | Fullerton et al. | | |
| 2010/0171578 | A1 | 7/2010 | Fiedler | | |
| 2010/0283269 | A1 | 11/2010 | Fiedler | | |
| 2010/0308605 | A1 | 12/2010 | Fiedler | | |
| 2011/0001025 | A1 | 1/2011 | Fiedler | | |
| 2011/0018661 | A1 | 1/2011 | Fullerton et al. | | |
| 2011/0068885 | A1 | 3/2011 | Fullerton et al. | | |
| 2011/0199171 | A1 * | 8/2011 | Prest | G06F 1/1616 | 335/296 |

OTHER PUBLICATIONS

GB Search Report, dated Sep. 16, 2011, issued in priority GB Application No. GB 1108886.1.
European Search Report, dated Nov. 29, 2018, issued in related European Application No. EP 18188465.

* cited by examiner

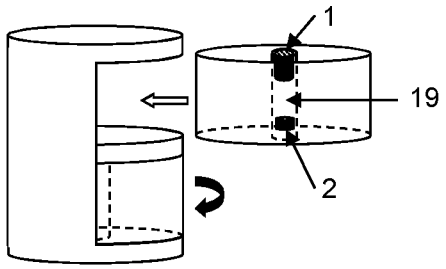
Figure 8
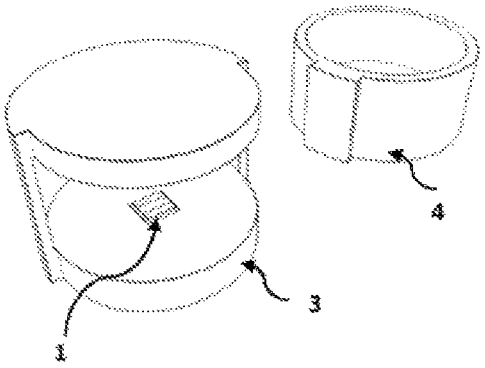
Figure 8.b
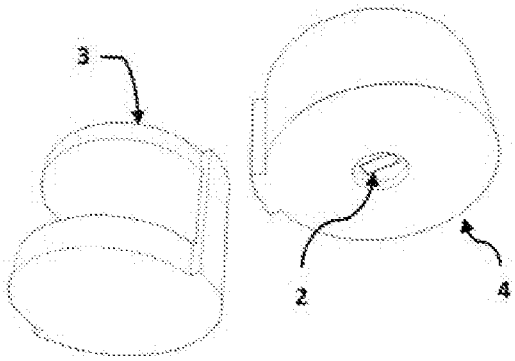
Figure 8.c

REPLACEMENT SHEET
Application No. 15/627,718

MAGNETIC FIXINGS AND CONNECTORS

CROSS-REFERENCE TO RELATED APPLICATIONS

This application is a continuation-in-part of U.S. application Ser. No. 14/867,700, filed Sep. 28, 2015, which is a continuation of U.S. application Ser. No. 14/119,946, filed Nov. 25, 2013, which claims the priority of International Application No. PCT/EP2012/059870, filed May 25, 2012, which claims priority to Great Britain Application No. 1108886.1, filed May 26, 2011; Great Britain Application No. 1121222.2, filed Dec. 11, 2011; and Great Britain Application No. 1201493.2, filed Jan. 30, 2012, the entire contents of each of which is fully incorporated herein by reference.

TECHNICAL FIELD

The present invention relates to magnet fixings and connectors.

BACKGROUND

Various magnetic fixing arrangements are described in the following documents: US2011/001025, US2011/0068885, U.S. Pat. No. 5,367,891, US2010/0171578, US2009/0273422, DE145325.

SUMMARY

According to a first aspect of the present invention there is provided a mechanism for fixing together first and second parts and comprising:

first and second guides provided respectively in or attached to the first and second parts; and first and second magnetic components coupled respectively to the first and second guides such that the first magnetic component is rotatable with the first guide and with the first part and the second magnetic component cannot rotate relative to the second guide, the magnetic components being moveable axially and rotationally with respect to each other and having magnetic poles oriented such that rotation of said first magnetic component causes relative axial movement of the magnetic components between a locking position in which one of the magnetic components straddles the two guides and an unlocking position in which it does not straddle the two guides.

Other aspects of the present invention are set out in the appended claims.

BRIEF DESCRIPTION OF THE DRAWINGS

FIG. 8 illustrates a jewelry box comprising a push-pull fixing mechanism;

FIGS. 8*b* and 8*c* illustrate an alternative jewelry box comprising a single push-pull fixing mechanism;

DETAILED DESCRIPTION

Hereafter, a "push-pull" designates a device that is made of first and second magnetic components moveable axially and rotationally with respect to each other, and having magnetic poles orientated such that relative rotation causes one of the magnetic components, hereafter called the first component, to move between a locking position in which that magnetic component straddles two guides, made of antimagnetic material (i.e. made of a material that is magnetically neutral such as plastic, wood, aluminium etc. . . . ), and an unlocking position in which that does not straddle the two guides. The straddling will prevent mechanically the two guides to move in a sheer or folding motion.

Such push-pulls offer various advantages such as aesthetics (e.g. the mechanisms can be totally hidden from view), haptic, rapidity/simplicity of use, safety, cost reduction (e.g. by reducing structure assembling/disassembling times), entertainment, novelty/fashion, improve quality, etc. The trade domains that can benefit from such push-pulls devices include toys, furniture, bathroom equipment, boxes (e.g. jewelry cases), bags, clasps, scaffolding, building frames, panel frames, item holders, fastening devices, lifting or pulling mechanisms etc.

The higher the number of available functionalities, the higher the number of trade domains that can benefit from such push-pulls and the higher the number of applications that can either be developed or benefit from the push-pulls. Thus, the purpose of this document is to provide a list of such push-pull devices that offers various functionalities.

All push-pulls described in this document can be manufactured first and then integrated (e.g. screwed, glued etc. . . . ) in other parts second; they can be bespoke or standardised and potentially sold in shops as stand alone products. They can also be manufactured at the same time as the other parts so that no later integration is required; this can be for various reasons such as technical or financial.

In most of the examples a rotation of 180° of the magnetic components relatively to each other is required to switch from a maximum attraction force to a maximum repulsion force between the components. This is for simplicity only. Other rotational angles could have been used.

The mechanical strength that prevents the guides to move relatively to each others, in a sheer or folding motion, is a function of the material that is used to straddle the guides.

This material can be the material that is used to make the magnet. It can also be the one that is attached to the magnets (e.g. to wrap the magnets) and that moves with the magnets. Thus "magnetic component" designates both the magnet(s) and their surrounding material.

In all the figures of this document, the curved arrow represents the rotational axis of the magnetic components relatively to each others. When it is black, its orientation is aligned with the sliding axis of the first component (1); it is white otherwise.

Figure 1:
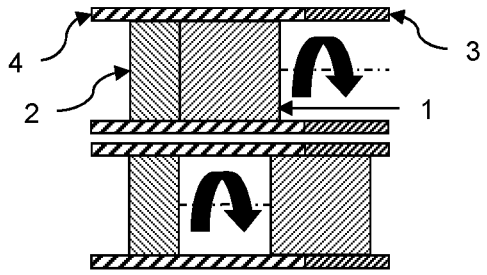
FIGS. 1 to 3 illustrate the general principle of push-pulls fixing mechanisms.
Figure 2:
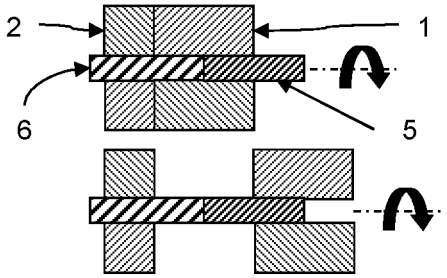
Figure 3:
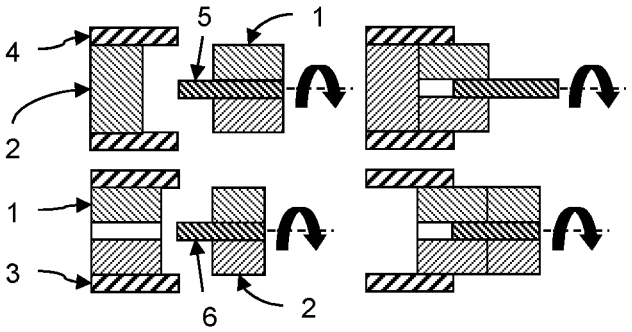
Figure 26:
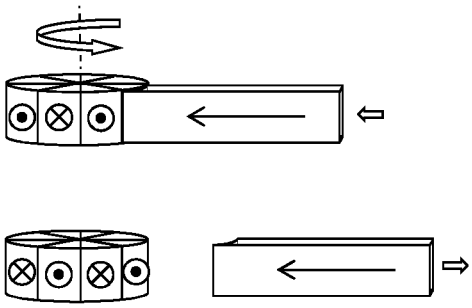

FIG. 1, FIG. 2 and FIG. 3 illustrate the general principle of push-pulls described in this document. All these figures represent a cross section of the device that contains the sliding axis of the first component (1). All these figures only show aligned rotational axis; however, as discussed further down (e.g. see FIG. 26), non-aligned rotational axes are possible as well. In FIG. 1 the first component (1) slides only inside external guides (3) and (4). By definition an external guide acts on the external edges of the magnets. In practice, an external guide is typically a case in which the first magnet can slide and, if required, rotate. In FIG. 2 the first component (1) slides only around internal guides (5) and (6). By definition an internal guide goes through the magnets and acts on the internal edges of the magnets. In practice, an internal guide is typically a shaft around which the first magnet slide and, if required, rotate. In FIG. 3 the first component (1) slides along internal and external guides. In all cases, a relative rotation of the magnetic components reverses the direction of the magnetic forces acting on the components. However, the straddling can take place when the magnetic force is repulsive, as illustrated in FIG. 1, or when it is attractive, as illustrated in FIG. 2 and FIG. 3. Hereafter, the former and latter types of push-pulls are called, respectively, inverted and right push-pulls. In addition, for right push-pulls, a mechanism can be added to prevent the first component to slide along the guide it is in or around when it does not straddle the guides, without preventing the first component from sliding when under the magnetic influence of the second component. This is to prevent some unwanted sliding that may prevent some application to work properly. Such mechanism could be some slightly ferromagnetic material located along the guide that creates a force that can attract enough the first magnet and that can be easily overwhelmed by the magnetic force generated by the second component.

Figure 4:
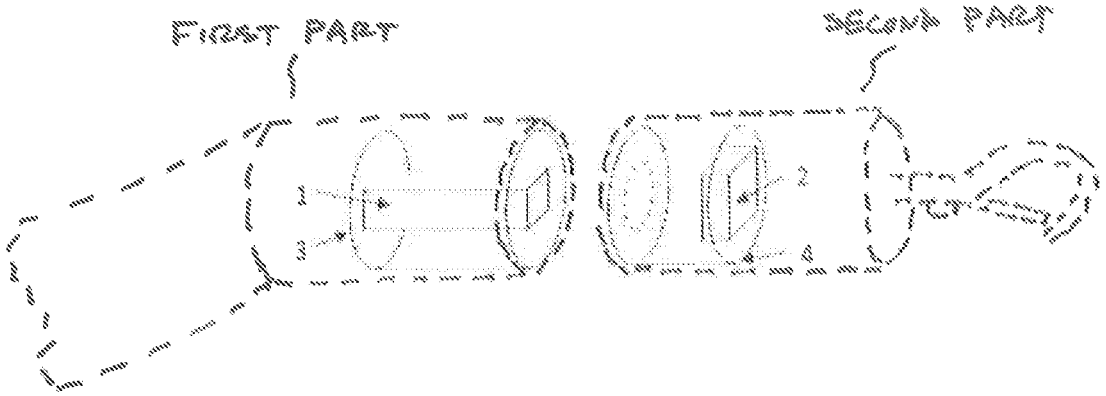
FIGS. 4 to 6 illustrate various embodiments of fixing mechanisms, showing internal components.
Figure 4:
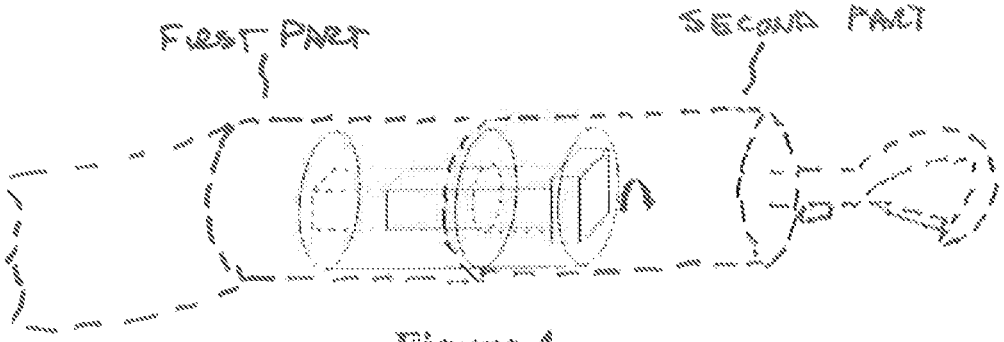
Figure 5:
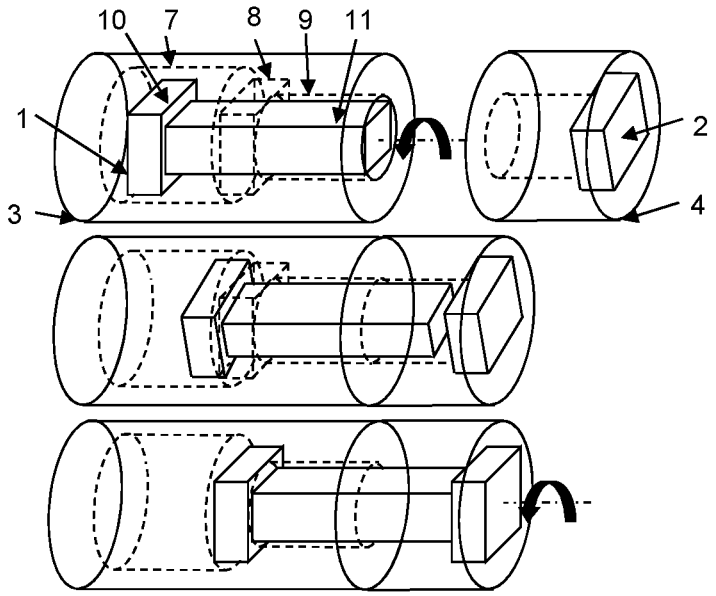
Figure 6:
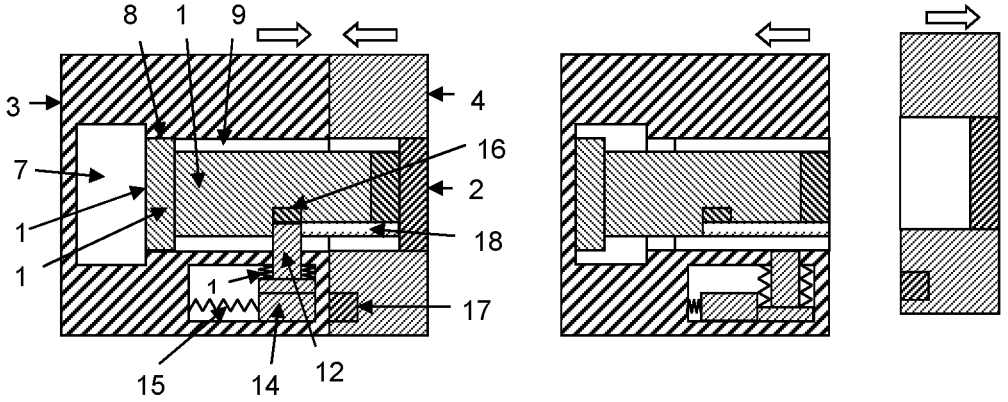

FIG. 4 to FIG. 6 illustrate the case when the first component (1) is rotatable by a guide while the second component (2) cannot rotate relatively to the other guide. In these figures, the first component (1) slides inside external guides (3) and (4). It could have slide around internal guides. One of the advantages of such an approach is that the straddling/un-straddling mechanism can be totally hidden from the view.

The first component (1) slides only if the two magnetic components are orientated appropriately. In FIG. 4 the guide (3) must be rotated relatively to the guide (4) so that the magnetic force becomes attractive. On the contrary, in FIG. 5, it does need to be rotated. This is due to the fact that the ability of the first component (1) to rotate relatively to its guide is a function of its linear position along that guide. Such functionality can simplify the procedure required by the users to trigger the motion of the first component.

In FIG. 5, guide (3) is made of four sections. The cross sections of sections (7) and (9) are circular. It is non-circular for section (8). The diameter of section (7) is larger than the one of section (9). The first component (1) is made of two parts, both with non-circular cross section. However, one of the two cross sections is smaller than the other one. The larger section (10) is called the non-circular head and can rotate in section (7) but not in (8). It cannot enter section (9). The smaller section (11) can rotate in all sections (7), (8) and (9). The magnetic component (2) cannot rotate in guide (4). In the top figure, the non-circular head (10) of the first component (1) is in the cylindrical section (7) of guide (3) and can freely rotate in section (7). The guides are not straddled. The first component (1) will rotate spontaneously relatively to component (2) so that both components attract each others. In the middle figure, the non-circular head (10) of the first component (1) is in the cylindrical section (7) of guide (3) but is not necessarily aligned with the non-circular section (8). The guides are partially straddled. At this stage, guides (3) and (4) can rotate relatively to each others till the non-circular head (10) is aligned with the non-circular section (8). When the non-circular head (10) is aligned with section (8) it can go into it. As a result, the first component (1) will be fully inside guide (4). During such a rotation, the magnetic pull should prevent the two components to rotate relatively to each others if the friction between the first component (1) and guide (3) is weak enough. In the bottom figure, the non-circular head (10) of the first component is inside the non-circular section (8) and cannot freely rotate relatively to guide (3). The guides are fully straddled. Now, rotating guide (3) relatively to guide (4) will induce a relative rotation of the two magnetic components and, ultimately, the un-straddling of the guides. However, as soon as the first component can rotate again in guide (3) it will rotate and move back toward the second magnetic component; in other words the un-straddling is not stable. To prevent this, an additional mechanism is required. This mechanism needs to block the rotation of the first component (1) relatively to guide (3) when it straddles fully the two guides and to release such blocking only when the two guides are disconnected. An example of such a mechanism is illustrated in FIG. 6.

FIG. 6 is a cross section of FIG. 5 along the sliding axis. When the two guides are away from each other pin (12) moves vertically and is pushed inside guide (3) by spring(s) (13) and pin (14) moves horizontally and is pulled away from the edge of guide (3) by another spring (15). When the guides are fully straddled (left figure), magnet (16) pulls pin (12) up inside a groove (18) in first component (1) and compresses the spring(s) (13). At least when the magnetic force repulses the two components, a second magnet (17) in guide (4) pulls pin (14) underneath pin (12) and extends spring (15). Pin (12) cannot go down as long as magnet (17) pull pin (14). The first component (1) can now be pushed back inside guide (3) without being able to rotate; the un-straddling is stable. When the guides are disconnected (right figure), pin (12) and pin (14) are moved back to their positions by, respectively, springs (13) and (15). The first component is free again to rotate when the head (10) is inside section (7).

If the head (10) is non-circular and non-symmetrical (e.g. a trapezoid) then the orientation of the first component (1) relatively to section (9) will always be the same and only one mechanism described in FIG. 6 will be required.

Figure 7:
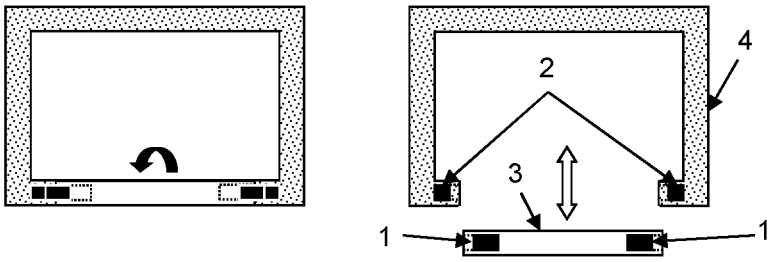
FIG. 7 illustrates a toilet roll holder comprising a pair of push-pull fixing mechanisms.

FIG. 7 and FIG. 8 are examples of applications of the types of push-pulls illustrated in FIG. 4 to FIG. 6 where a first part is attached to a second part, the second part being attachable to the first part at two fixing points such that the second part is rotatable with respect to the first part about an axis extending between the two fixing points. At least one of the fixing points is provided by the push-pulls. External, internal or mixed push-pulls can be used at the fixing points.

However, the FIG. 7 and FIG. 8 applications use the devices illustrated in FIG. 4 to FIG. 6; i.e. push-pulls with external guides.

FIG. 7 is a see through top down view of a classical toilet roll holder. The push-pull is fixed on both ends of the removable bar. When the bar is inserted the first component (1) automatically slides and blocks the bar between the arms of the frame (4). When it is rotated, the guides are unstraddled and the bar can be removed. Same principle for FIG. 8 except that the device is used to connect rotating drawers of what could be a jewelry box. The component at the top of guide (19) is the first component; the second component will be above and located in the frame of the box. This is the opposite for the push-pull at the bottom of guide (19) merely to prevent the first component to pop-out of guide (19) when the drawer is removed.

FIGS. 8*b* and 8*c* illustrate a modified device of the type shown in FIG. 8. According to the modified design only a single push-pull is provided operating between the base of the drawer 4 and the housing. Insertion of the drawing into the housing results in automatic engagement of the push-pull. The push-pull is disengaged by rotating the drawer sufficiently in a given direction, e.g. anti-clockwise, whereupon it can be pulled out from the housing.

Figure 9:
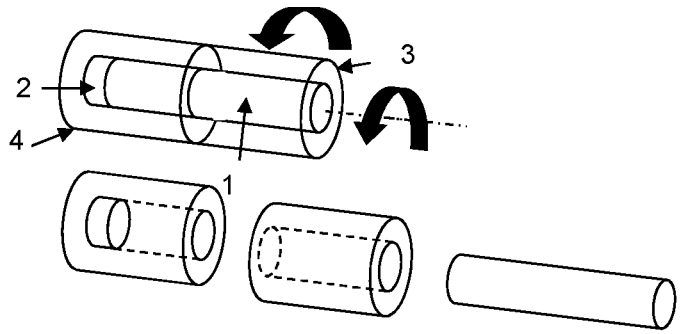
FIGS. 9 to 11 illustrate a drawer arrangement including a fixing mechanism.
Figure 10:
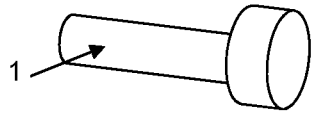
Figure 11:
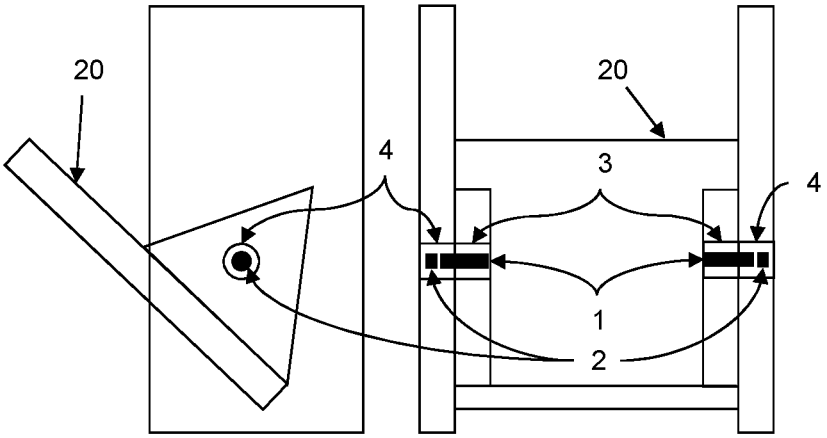

FIG. 9 to FIG. 11 illustrate the case when the first component (1) can rotate relatively to guide (3) while the second component (2) cannot rotate relatively to guide (4). In these figures, the first component (1) slides inside external guides (3) and (4). It could have slide around internal guides.

FIG. 10 illustrates the fact that a head can be added at one of the extremities of the first component (1) (or of the internal guides, if internal guides were used). Such a head can be added, for instance, to facilitate the manual rotation of the first component (10), to couple the two guides together and/or to prevent the guide (3) to fall out of the first component (10).

FIG. 11 illustrates a possible application of such a device. It represents a piece of furniture that could be, typically, a shoe cabinet with pivoting doors (20). The device is used as a pivot around which the doors (20) can rotate.

Figure 12:
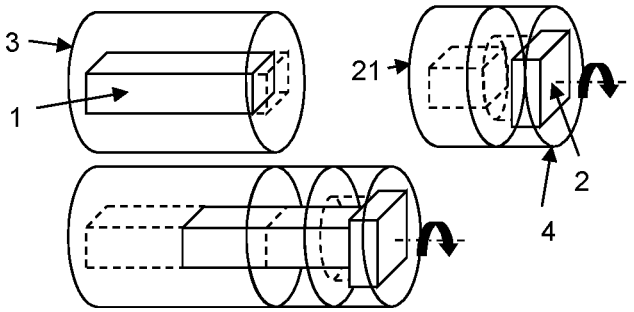
FIGS. 12 and 13 illustrate respective push-pull fixing mechanisms.
Figure 13:
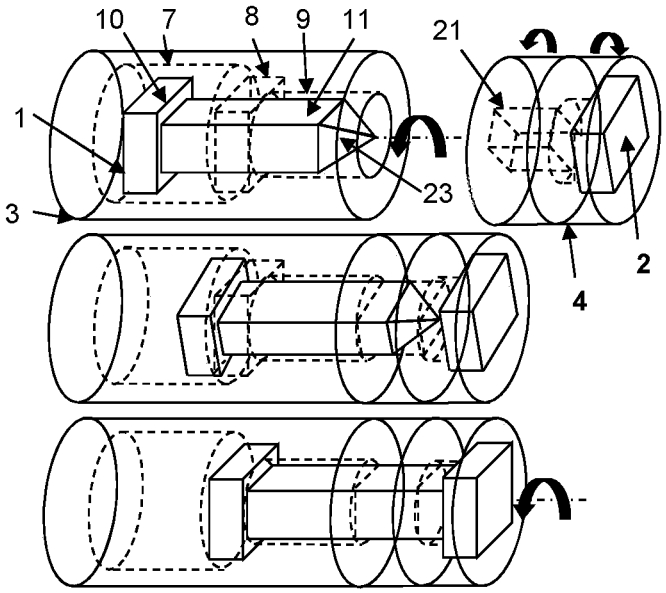
Figure 14:
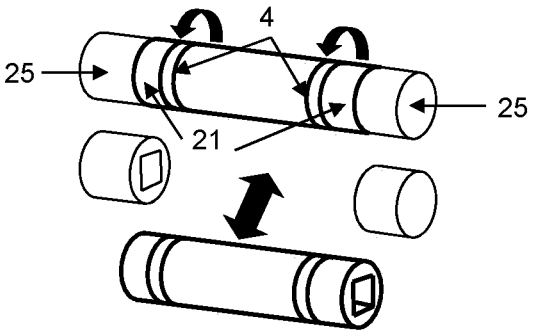
FIG. 14 illustrates a bar having a two-point fixing mechanism.

FIG. 12 to FIG. 14 illustrate the case when the first component (1) is rotatable both by guide (3) and guide (21) while the second component (2) can rotate relatively to guide (3) and guide (21) but cannot rotate relatively to guide (4). When guides (3), (21) and (4) are straddled, the first component (1) cannot rotate in guides (3) and (21) thus preventing these two guides from rotating relatively to each other. However, rotating guide (4) relatively to guides (3) and (21) will reverse the magnetic force direction. In these figures, the first component (1) slides inside external guides. It could have slide around internal guides.

In FIG. 12 guide (3) must be first rotated relatively to guide (21) and to guide (4) so that the magnetic force is attractive and that the first component (1) can slide in the non-circular cross-sections of both guide (3) and guide (21). On the contrary, in FIG. 13, such a relative orientation is not needed. This is due to two features. First, as for FIG. 5 the ability of the first component (1) to rotate relatively to its guide (3) is a function of its linear position along that guide (3). Such a feature will make the first component (1) to rotate spontaneously so that the magnetic force becomes attractive; if left free to rotate the second component (2) can also rotate. Second, the head of the extremity of the first component (23) and the cross-section of guide (21) are shaped so that the first component (1) can penetrate guide (21) even if the non-circular cross-sections of the first component (11) and of guide (21) are not orientated appropriately, for section (11) to slide inside guide (21), and that it forces the first component (1) to rotate relatively to guide (21) so that both non-circular cross sections of (11) and (21) become orientated appropriately. In FIG. 12 the head (23) is a pentahedron. This is for illustration purpose only. Other shapes are possible. Once section (11) is inside (21), the first component (1) can still rotate inside guide (3). However, it cannot rotate inside guide (21). Rotating guides (21) relatively to guide (3) will rotate the first component (1) inside guide (3) till the non-circular head of the first component (10) is inside the non-circular section of guide (8). At this point the first component (1) will slide further inside the guides (21) and (4) and will not be able to rotate in guides (3) and (21). Note that (2) and (1) being magnetically coupled, (4) will rotate with (21). In addition, guide (3) is identical to the one described in FIG. 5. Therefore, a mechanism such as the one described in FIG. 6 is required.

FIG. 14 illustrates a possible application of such a device. It represents a safety bar (24) that can be easily installed and removed between a fixed frame (25). Such safety bar could be installed, for instance, in bathrooms for people with reduced mobility. In FIG. 14, the device, made of guides (21) and (4) is installed at both extremities of the bar (24). It could have been installed on one extremity only. The first component (1) is fully hidden from view. However, unlike the toilet roll holder, the actuating mechanism of the second component, i.e. guide (4), must be accessible and cannot be fully hidden.

In FIG. 14 there are two actuators (4) that are activated independently. An alternative embodiment could consider only one actuator acting on the two second components so that only one actuation is enough to unlock both sides simultaneously. Accidental rotation of the actuators can be made more difficult. For instance, the access to the actuators can be made difficult (e.g. by giving them a smaller diameter). The moving bar hosts the second components (2). It could have hosted the first component (1). One or both sides of the bar can be fitted with a push-pull device. Cross section perpendicular to the sliding path of the first component of the first magnet can be arranged so that the relative orientation of the two guides is controlled (e.g. a trapezoid shape for a unique orientation, or an oval shape for two acceptable orientations).

Figure 15A:
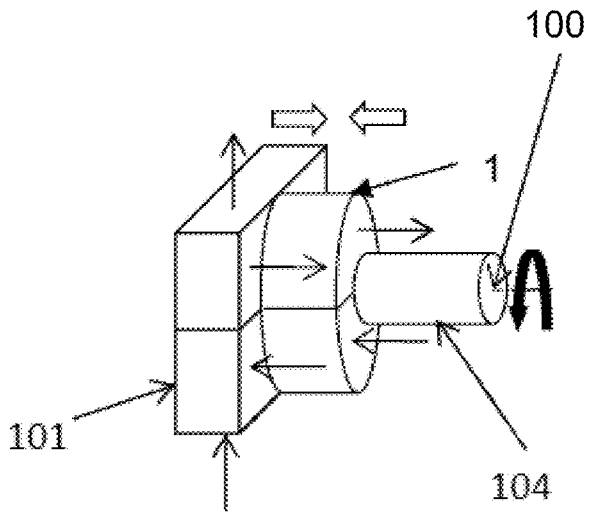
FIGS. 15A to 15C are an exploded view illustrating three different configurations of a fixing mechanism configured to allow two parts to pivot relative to one another.
Figure 15B:
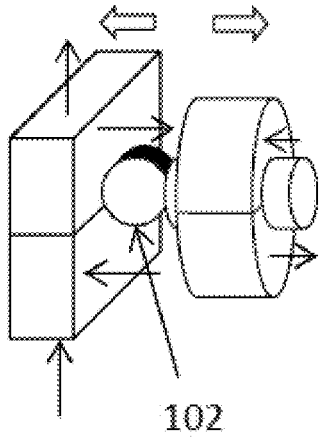
Figure 15C:
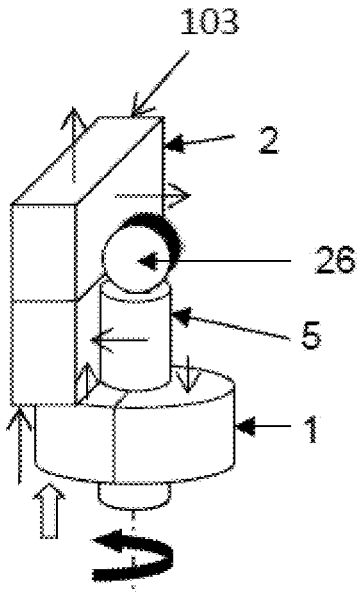
Figure 16:
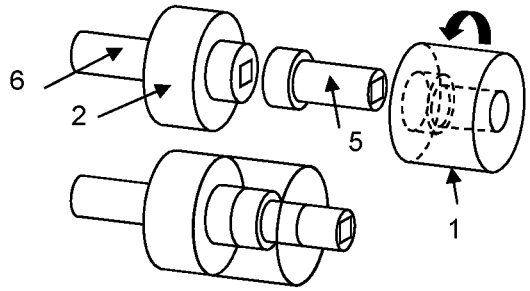
FIG. 16 illustrates a further fixing mechanism.
Figure 17:
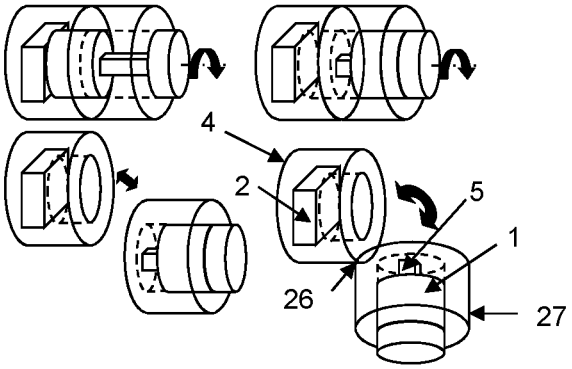
FIG. 17 illustrates a fixing mechanism having a mixed guide arrangement.

FIG. 15, FIG. 16 and FIG. 17 illustrate the use of internal and mixed guides as well as the fact that internal or external guides can be attached by a hinge.

FIG. 15 is a perspective view of a push-pull that illustrates two internal guides attached by a hinge. Guide (5) goes through the first component (1) and is explicitly represented. Guide (6) goes through the second component (2) and is implicit. When components are aligned the first component (1) will spontaneously rotate to be attracted by the second component (2). In the left figure the two guides are straddled. In the middle figure, the first component (1) is rotated. The two components repulse each other. In the right figure, the two guides can be folded around the hinge (26). In addition, the directions of the dipole axes are represented and are illustrated by straight arrows. With this specific polarisation (other polarisations are possible, e.g. see FIG. 23 to FIG. 28) the first component (1) is attracted upward by the magnetic field at the bottom of the second component (2) thus magnetically locking the two guides in the folded position. Such device could represent, for instance, one of the two arms of a folding table attached to a wall.

FIG. 16 illustrates a coupling device (discussed in FIG. 22) between two internal guides that are not attached by a hinge. The internal guides could be pipes in which liquid could circulate. The first component (1) rotates around guide (6). It may or may not rotate relatively to guide (5).

FIG. 17 illustrates an example of mixed guiding. The first component (1) cannot rotate around the internal guide (5) but can rotate in the external guide (4). The internal guide (5) and the first component (1) are located inside a case (27) in which they can rotate. The second component (2) cannot rotate in guide (4). Thus, rotating the internal guide (5) relatively to a case (27) that is prevented from rotating relatively to the external guide (4) will trigger a magnetic attraction or repulsion as illustrated, respectively, in the top left and right figures of FIG. 17. Once detached, the external guide (4) and the case/internal guide (27) can be either separated or folded, if joint by a hinge (26) (implicitly represented), as illustrated, respectively, in the bottom left and right figures of FIG. 17. A hinge can attach internal guides or external guide/cases.

Figure 18:
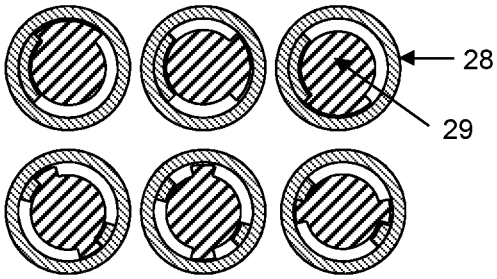
FIG. 18 illustrates the case when a magnetic component can rotate only over an angular range of rotation of the guide.

FIG. 18 illustrates the case when a magnetic component can rotate only over an angular range of rotation of the guide. This is illustrated in. FIG. 18 is a cross section of an external (28) and internal (29) component, perpendicular to the sliding axis of the external component (28) relatively to the internal one (29). The external and internal components can be, respectively, a guide or a magnetic component; or vice versa.

In FIG. 18, from left to right the internal component has rotated relatively to the external component by 180° and 120° for, respectively, the top and bottom rows; these angular values of 180° and 120° are arbitrary, i.e. other values could have been used. In addition, the top and bottom rows illustrate, respectively, a single and multiple (i.e. double in this case) blocking system.

Figure 19:
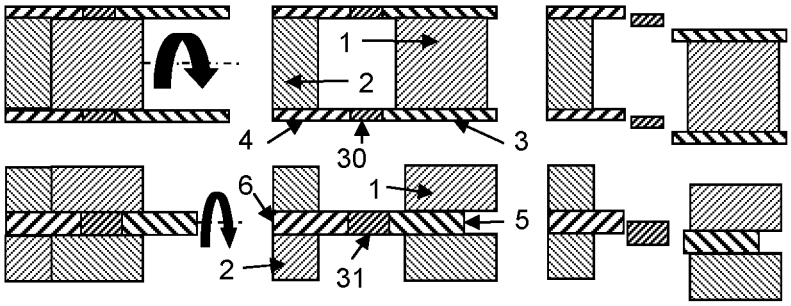
FIG. 19 to FIG. 21 illustrate the case when one or more additional guides are added to two initial internal and/or external guides.
Figure 21:
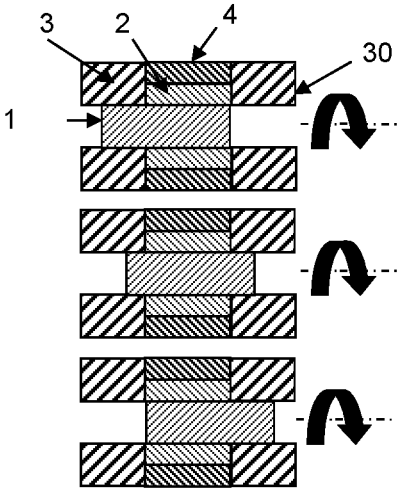

FIG. 19 and FIG. 21 illustrate the case when one or more additional guides are added to the two initial internal and/or external guides. In addition, they also illustrate the case when the guides are either all straddled or all un-straddled. It does not have to be the case as illustrated in FIG. 21. In all figures only one additional guide is represented; more additional guides are possible. In addition, the guides go from straddled to un-straddled from left to right.

Figure 20:
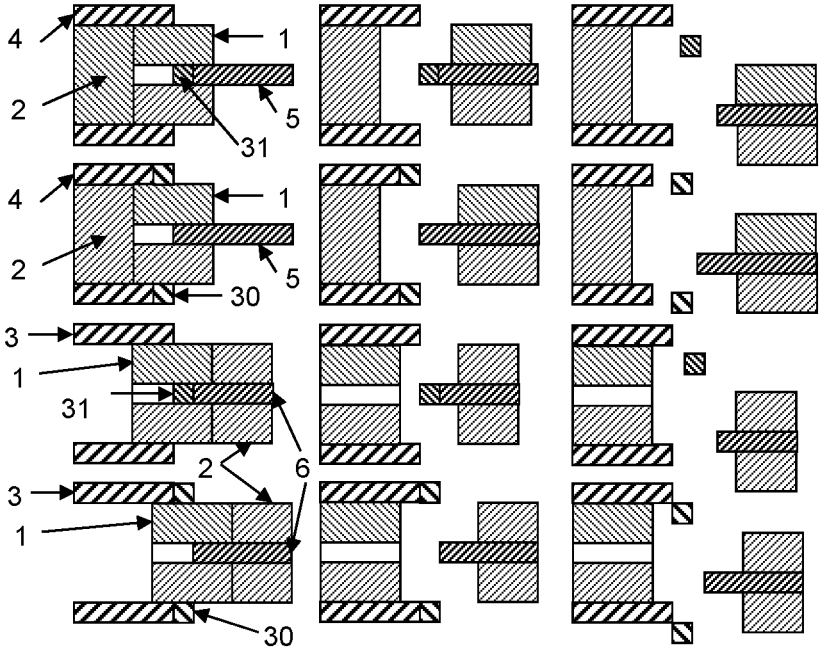

FIG. 19 illustrates the case for a device using either external only (top row) or internal only (bottom row) guides. FIG. 20 illustrates the case for mixed guides. In row 1, the first component (1) is mounted around an internal (5) guide and the additional guide (31) is internal. In row 2, the first component (1) is mounted around an internal guide (5) and the additional guide (30) is external. In row 3, the first component (1) is mounted inside an external guide (3) and the additional guide (31) is internal. In row 4, the first component (1) is mounted inside an external guide (3) and the additional guide (30) is external.

FIG. 21 illustrates the case when the guides that are straddled vary with the relative position of the first (1) and second (2) components as well as the combination of an inverted push-pull with additional guides. In the figure, the guides are external. They could have been internal. There are three guides: (3), (4) and the additional guide (30). The first component (1) does not rotate in guide (3) or (30). It can rotate inside guide (4). The second component (2) cannot rotate in guide (4). Guide (4) can rotate relatively to guides (3) and (30). Thus any rotation of guide (4) relatively to guides (3) or (30) will reverse the magnetic force direction between the first and second component (1) and (2). In addition, the magnets can be configured so that there are three possible stable positions of the first component relatively to guide (4). In the top and bottom figures the first component (1) straddles only two guides. In the middle figures it straddles three guides.

Figure 22:
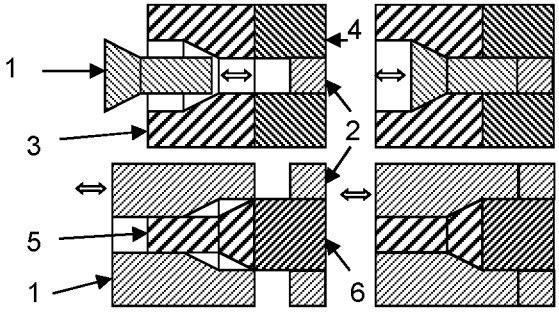
FIG. 22 illustrates a further fixing mechanism

FIG. 22 illustrates how the first component (1) can be used to couple the guides. It is a cross section of the first component straddling two guides. In the top and bottom row of the figure the guides are, respectively, external and internal. The conic shape of the internal component, i.e. the first component (1) in the top row and the guide (5) in the bottom row, does not allow the latter to pop-out of the guide (3) in the top row and of the first component (1) in the bottom row, when the first component (1) straddles the guides. The left and right columns show the push-pull, respectively, before and after the straddling. The white arrows represent the relative motion of the internal and external components. Note that the conic shape is for illustration. Other shapes could have been used with identical results.

In addition, when straddling the guide, the first component can be mechanically prevented by mechanical forces that can be released by relative rotation of the magnets and/or of the guides (e.g. hooks) to detach from the second component under the influence of external forces.

FIG. 23 to FIG. 28 illustrate some of the many possible arrangements of the magnets inside each of the two magnetic components that can be implemented to reverse the magnetic force direction between the two magnetic components by relative rotation of the latter. The white straight arrow represents the direction of motion of the right magnetic component relatively to the other one. It is aligned with the sliding axis of the first component in the push-pulls. The black straight arrows represent the direction of the magnetic dipole axes polarity (i.e. south to north poles). The first and second components can be, respectively, the right and left set of magnets or the opposite. The outcome of the rotation showed in each top figure is shown on the figure immediately underneath. The magnetic force is attractive and repulsive in, respectively, the top and bottom row.

The alignment of the axis of rotation relatively to the sliding path of the first component varies with the figures. For FIG. 23, FIG. 24 and FIG. 25 there is only one axis of rotation and the later is aligned. For FIG. 26, there is only one axis of rotation and the latter is not aligned. For FIG. 27 and FIG. 28, there are two axes of rotation; one is aligned the other one is not.

Figure 23:
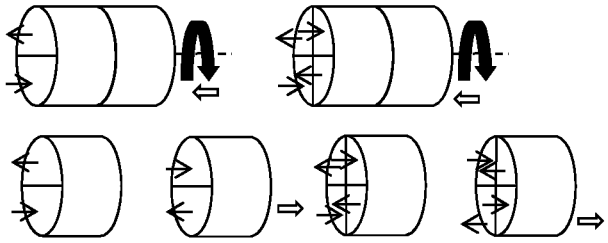
FIGS. 23 to 28 illustrate possible alternative fixing mechanisms.
Figure 24:
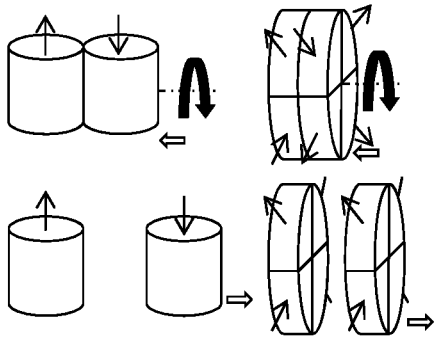
Figure 25:
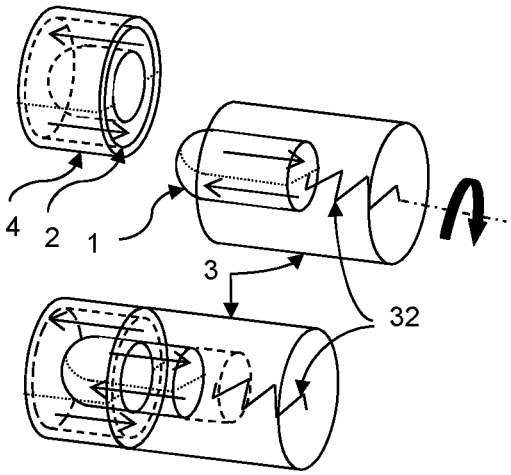
Figure 27:
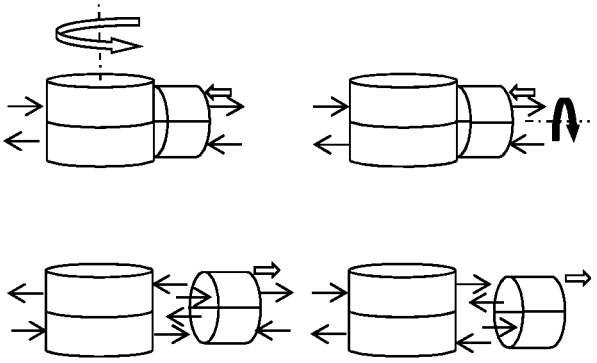
Figure 28:
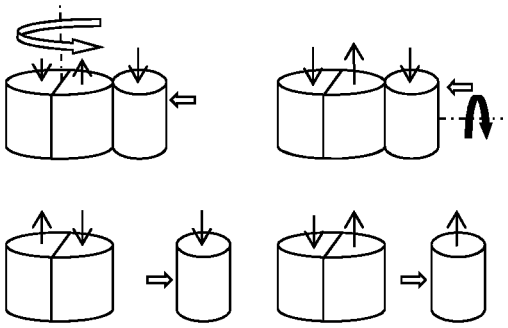

The dipole axes are all aligned with the sliding path of the first component including during the rotation for FIG. 23 and FIG. 25 but not for one of the magnetic component during the rotation for FIG. 27. They are not aligned for FIG. 24, FIG. 28 and for one of the two magnetic components of FIG. 26.

For FIG. 23 and FIG. 24 the rotation required to reverse the magnetic attraction is equal to 180° and 90° in, respectively, the left and right column (other angles would have been possible). When the magnets are joined, the aligned polarisation (FIG. 23) is very likely to offer a magnetic pull that is significantly higher than the non aligned one (FIG. 24). However, the maximum distance of repulsion/attraction between the two sets of magnets is very likely to be significantly higher for non-aligned magnets than for aligned magnets. This offers a possible trade-off depending on the applications.

FIG. 25 is similar to FIG. 23. The difference is that the first component (1) slides inside the second component (2). The first component (1) cannot rotate in guide (3) but can rotate in guide (4). The second component (2) cannot rotate in guide (4). It is illustrated for external guides only. Internal and mixed guides could have been used as well. In that example, the orientations of the dipole axes are all parallel and aligned with the sliding path of the first component; they could have been not all aligned and not all parallel. With the specific magnetic configuration showed in FIG. 25, a potential barrier will prevent the first component (1) to enter guide (4). An additional force is required. It is provided by a spring (32) in this example. The rounded head of the first component will help the edges of guide (4) to push the latter inside guide (3) if the two guides are aligned in a sheer motion only; sheer motion only are illustrated, for instance, in FIG. 7 or FIG. 8. As soon as the head is pushed inside guide (4) by spring (32) the first component (1) will spontaneously move inside the guide (4).

FIG. 29 to FIG. 36 illustrate the concept of multiple push-pull. A multiple push-pull is made of several single push-pulls that share one of the magnetic components; i.e. at least 3 magnetic components and 3 guides are involved. The figures below only deal with multiple push-pulls that share their second magnetic component. However, multiple push-pulls can also share their first component. Multiple push-pulls can typically be used to assemble 2 and/or 3 dimensional structures. They can link together external guides only, internal guides only or mixed guides.

For a given multiple push-pull that shares the second component, the directions of the magnetic forces that act on the non-shared components can be all reversed simultaneously only, can be all reversed individually only, or can be both reversed simultaneously (for some or all of the first components) and individually.

Figure 31:
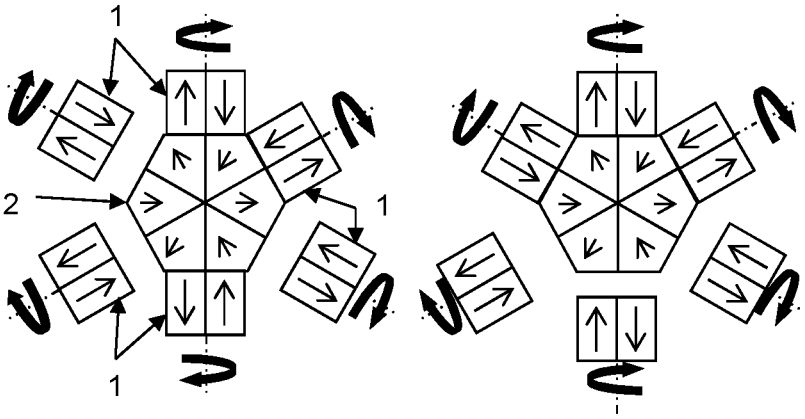

FIG. 31 illustrates the case when the reversion is individual only. A reversion that is simultaneous only would use, for instance, a magnetic configuration as described in FIG. 26. In that latter case, the shared magnet would be the cylindrical one on the left of FIG. 26 and the first components would be like the rectangular magnet on the right. All other figures illustrate the case when the reversion can be both simultaneous and individual.

Figure 29:
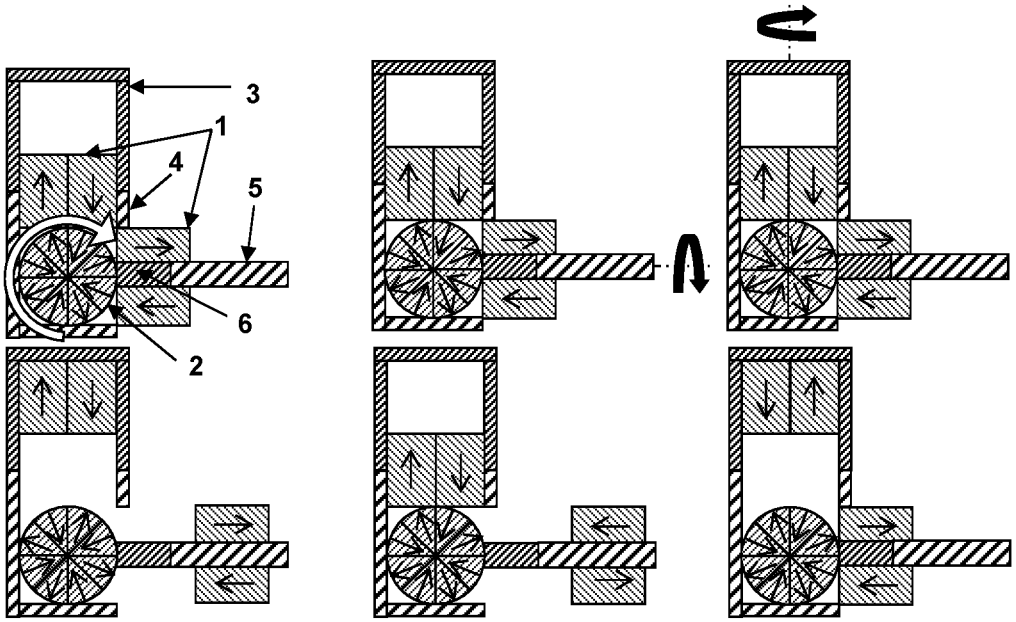
FIG. 29 to FIG. 36 further illustrate the concept of a multiple push-pull.
Figure 30:
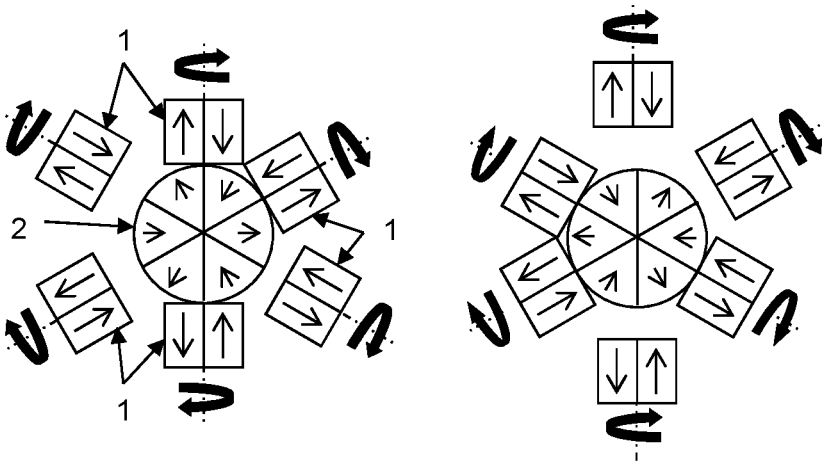
Figure 33:
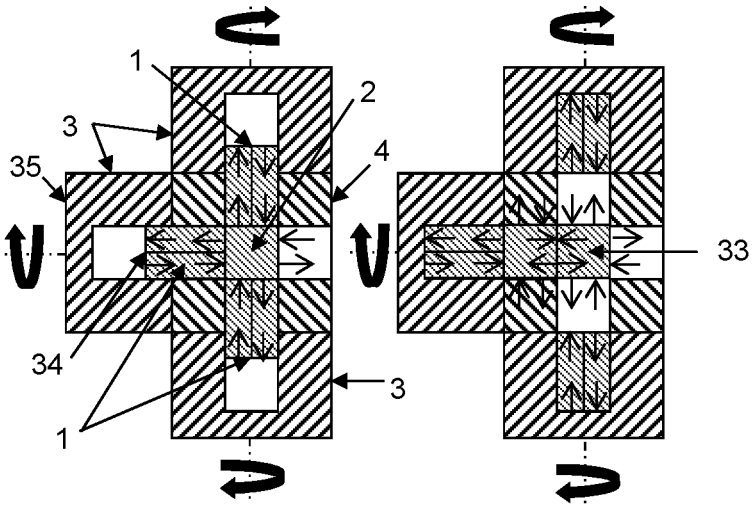

FIG. 29 and FIG. 30 illustrate a simultaneous reversion by rotation. FIG. 33 and above illustrate a simultaneous reversion by linear motion.

FIG. 29 is a cross section of one single push-pull with external guides and of one single push-pull with internal guide. The shared component (2) is the circular magnet of FIG. 26. The first component (1) is made of a set of two magnets as described in FIG. 23. Other magnetic configuration could have been used, such as the one described in FIG. 28. In that latter case, one of the first components would have been a mono-polar magnet, as the right magnet in FIG. 28 while the other one would have been a multi-polar magnet as the ones described in the left column of FIG. 23 (to attach on top of the double magnet of FIG. 28).

In FIG. 29 the top figures indicates the relative positions of all the components before the rotation and the rotation that is executed. The result of each rotation is provided in the figures immediately underneath. For the left column, the axis of rotation is perpendicular to the page (simultaneous reversion) as indicated by the white circle arrow. It is parallel for the other two columns (individual reversions).

FIG. 30 and FIG. 31 illustrate the case when numerous push-pulls can be assembled together. A total of 8 single push-pulls can be assembled: 6 in the plan of the page and 2 perpendicularly to the page (for the 2 perpendicular to the page, the polarisation is similar to the one described in the right column of FIG. 24—i.e. with 6 magnetic sectors instead of 4); these latter two first components are not represented. The figure is a top down view of the magnetic components only; for simplicity the guides have not been represented. In that specific configuration all magnetic forces are simultaneously reversed for all single push-pulls each time there is a rotation of 60° along an axis that is perpendicular to the page. However, a rotation of 180° and 60° are required for, respectively, the 6 first components that are in the plan of the page and the 2 first components that are perpendicular to the page to reverse individually their associated magnetic force direction.

Figure 32:
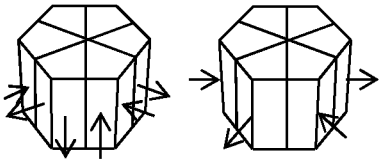

FIG. 32 is a perspective view of the shared magnet of FIG. 31. The shared magnet of FIG. 30 would only differ by its cylindrical shape. It shows two different types of polarisation. The polarisation of the right figure is the one used in FIG. 31. It goes through the vertexes of the hexagon. The polarisation on the left goes through the sides of the hexagon.

Figure 35:
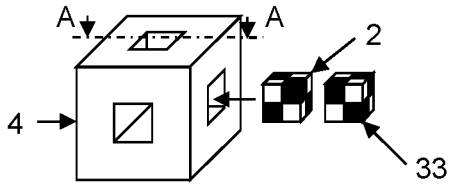

FIG. 33 is a cross section along the AA line of FIG. 35 of the first (1) and second components (2) and associated guides of a multiple push-pulls with. Any rotation along the black curved arrows is individual. The shared component has a cubic shape; hence, there are six single push-pulls (one per face of the cube). In the left figure, at least 3 guides are straddled. In the right figure, another cube (33), identical to the shared one (2) but with opposite polarisations is inserted into guide (4). It pushes the initial cube (2) and the horizontal first components (34) to the left of the figure. As a result, the horizontal guide (35) and guide (4) are unstraddled. In addition, all the other first components (1) are pushed back inside their respective guides (3); because of the inverted polarisation. Thus, all the guides have been un-straddled simultaneously by linear motion.

Figure 34:
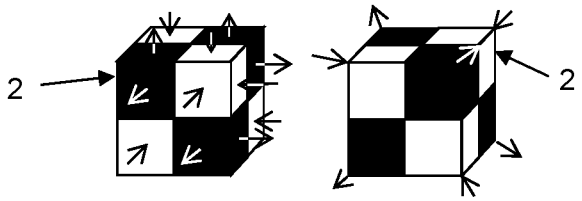

FIG. 34 illustrates in more details the possible directions of the dipole axes of the cube. The orientations are all perpendicular to the cube faces in the left figure and go through the vertexes of the cube in the right figure. With such polarisations any rotation of 90° of the cube along any of the 3 axes of rotations that are perpendicular to the faces of the cube will automatically reverse the direction of the dipole axes.

FIG. 35 is a perspective view of guide (4) as well as the motion of the two cubic components (2) and (33) relatively to guide (4).

Figure 36:
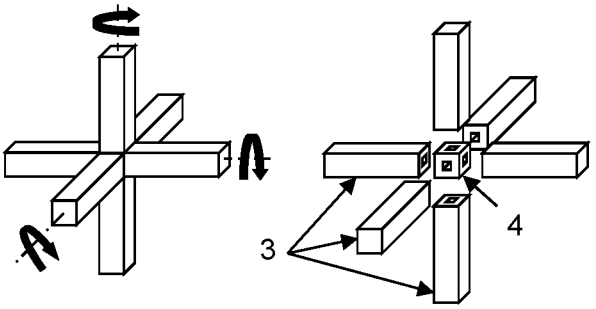

FIG. 36 is merely a perspective view of FIG. 33. One of the guides (3) needs to be removed to introduce the second cubic shared component (33) inside guide (4).

The invention claimed is:

1. An assembly comprising first and second parts defining first and second linear guides respectively, and a hinge coupling the first and second parts together to allow these parts to be moved relative to each other between a first position in which the guides are in alignment along a common axis and a second position in which the guides are out of alignment, the assembly further comprising a first magnetic component provided by or with said first linear guide and a second magnetic component moveable within or around said second linear guide, one or both of the magnetic components comprising at least one dipole magnet and the magnetic components being moveable with respect to each other and having the magnetic poles oriented to allow the second magnetic component to be moved between a locking position in which that magnetic component straddles the two guides and an unlocking position in which that magnetic component does not straddle the two guides, wherein said unlocking position allows for relative movement of the parts about said hinge, wherein said hinge has an axis being substantially perpendicular to said common axis.

2. The assembly according to claim 1, wherein the magnetic components are movable axially and rotationally with respect to each other.

3. The assembly according to claim 1, wherein the magnetic components are movable with respect to each other in a first linear direction and also in a second linear direction orthogonal to said first linear direction.

4. The assembly according to claim 1, wherein the first and second magnetic components present opposed magnetic faces, each of the faces comprising two or more magnetic poles.

5. The assembly according to claim 4, wherein each magnetic component comprises at least two dipole magnets aligned in parallel.

6. The assembly according to claim 1, wherein said first magnetic component is arranged slidably around said second guide and is able to slide over said second guide to straddle the two guides.

7. The assembly according to claim 1, wherein said hinge is provided by a rotational coupling between said first and second guides.

8. The assembly according to claim 1 and comprising a magnetic component coupled to said first part and configured to interact with said second magnetic component when the second part is in said unlocking position in order to magnetically retain the second part in the unlocking position.

9. The assembly according to claim 1, wherein said guides are defined internally within the first and second parts, said second magnetic component being moveable rotationally and axially with the linear guides when the guides are in alignment.

10. The assembly according to claim 1, wherein one of said magnetic components is a ferromagnetic component.

* * * * *